United States Patent [19]

Boothroyd

[11] Patent Number: 4,899,121

[45] Date of Patent: Feb. 6, 1990

[54] ALTERNATING CURRENT ELECTROMAGNET

[75] Inventor: Edwin J. Boothroyd, Asheville, N.C.

[73] Assignee: Westinghouse Electric Corp., Pittsburgh, Pa.

[21] Appl. No.: 345,873

[22] Filed: May 1, 1989

[51] Int. Cl.[4] ..... H01F 7/10

[52] U.S. Cl. ..... 335/245; 335/243

[58] Field of Search ..... 335/243, 244, 245, 246

[56] References Cited

U.S. PATENT DOCUMENTS

| | | | |
|---|---|---|---|
| 2,342,797 | 2/1944 | Ellis et al. | 335/245 |
| 3,283,275 | 11/1966 | Rider | 335/245 |
| 4,030,056 | 6/1977 | Patz | 335/245 |

*Primary Examiner*—George Harris

*Attorney, Agent, or Firm*—M. J. Moran

[57] ABSTRACT

An alternating current electromagnet with a magnetic core assembly is provided with a unique design for a sideplate. The sideplate has a slot with a lateral opening. In assembling the sideplate onto the side of the magnetic core, the slot receives a shading coil. A portion of the sideplate forming the slot extends across a channel formed in a pole face of the core to lock the shading coil into the channel along the sides of the core. The sideplate is formed in a C-configuration and interconnects two L-shape cores arranged in a C-configuration with a gap existing between the confronting faces of the lower legs of the cores.

11 Claims, 2 Drawing Sheets

FIG. 2
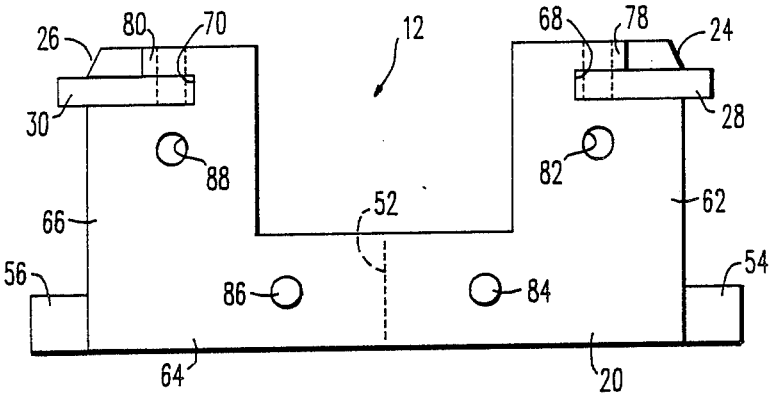
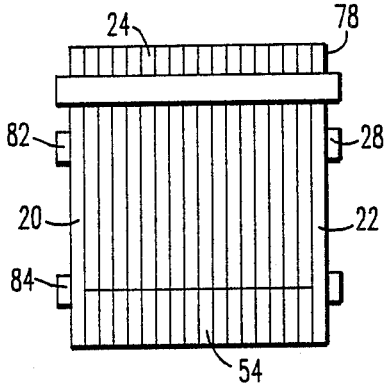
FIG. 4
FIG. 3
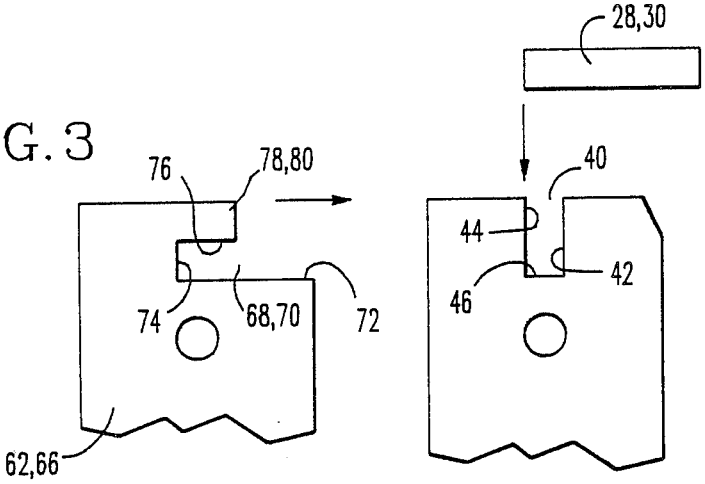

ALTERNATING CURRENT ELECTROMAGNET

BACKGROUND OF THE INVENTION

1. Field of the Invention

The invention relates to an alternating current electromagnet, and more specifically, to a design for a sideplate for securing a shading coil to a magnetic core of the electromagnet.

2. Description of the Prior Art

Alternating current electromagnets are wellknown. A typical application of an alternating current electromagnet is as an operating mechanism in an electrical contactor, such as a motor starter, where it is used to maintain the contacts of the electrical contact in a closed position.

A typical alternating current electromagnet has a magnetic assembly comprising a C-shape magnetic core forming two magnetic poles. An armature bridges these poles. A primary coil is arranged around each pole, and a 60 cycle alternating current is applied to the primary coil with the magnetic field collapsing 60 times per second. Springs in the electrical contactor tends to pull the armature away from the magnetic core, and therefore, the armature tends to oscillate with the magnetic field at 60 cycles per second. This condition causes noise in the system.

In order to reduce the oscillations, and thus the noise, a shading coil is provided in each pole face of the magnetic core. As is known to those in the art, a shading coil is a single turn, closed coil, and generally is mounted adjacent to the interface between the poles and the armature. Activation of the primary coil induces currents in the shading coil. These induced currents distort the magnetic field created by the primary coil, and change the time phase at which the alternating current goes to zero so that the magnetic field does not reach zero along the entire interface between the armature and the poles at the same instant, thereby reducing the extent of the oscillations of the armature.

In a typical alternating current electromagnet of the type discussed hereinbefore, the C-shape magnetic core is formed by two L-shape members which are either partially or totally separate from each other so that a gap exists to fix the inductance in the system. These L-shape members are typically comprised of several magnetic laminations or punchings and are interconnected by two C-shape sideplates, each attached on an opposed, parallel side of the magnetic core. An open channel in each of the pole faces of the core extends between these two sideplates, which in turn, have two slots, each cooperating with the channel in the two pole faces for receiving the shading coil. These two slots in each sideplate have a longitudinal opening which aligns with the channel in each pole face, such that in cross section the slots and the channel are in a C-configuration.

The shading coil is secured in the channel and slots by one of the well-known methods, such as by using an adhesive, or by staking, or by using a wire-form. In the staking method, the edges of the laminations or punchings of the core are upset along the channel in the pole face. In the wire-form method, a wire is looped over the shading coil, and a wire clip is used to secure the wire in place. This wire clip requires another slot or edge to bear against.

One of the major disadvantages of the prior art electromagnets is that several steps are required in assembling these electromagnets. First, the sideplates are attached to the core, and then the shading coil is attached to the pole face by one of the discussed methods. This two-step operation requires time and materials resulting in an increase in costs.

The adhesive method requires manual application of the adhesive, and a subsequent oven curing operation. Adhesive particles attach to the pole faces of the core, and in a grinding operation of the punchings to make the pole faces smooth, these adhesive particles may contaminate the coolant used in the grinding operation.

SUMMARY OF THE INVENTION

The present invention has solved the above described problems by providing a simple means for securing a shading coil to a magnetic core assembly.

The present invention provides a unique design for a sideplate of a magnetic core assembly, which design secures a shading coil to the pole face of a pole. The sideplate of the invention has a slot with a lateral opening and which, in effect, is located in cross section at a 90 angle relative to the open channel running transversely in the pole face. When the sideplate is attached to the core, a portion of the sideplate forming the slot extends across the channel along the side of the core thereby retaining the shading coil in the pole face.

It is, therefore, a broad object of the invention to provide in an alternating current electromagnet a magnetic core assembly which is simple in design, and which is easily assembled, reducing both the steps and materials involved in the assembling of the electromagnet, thereby reducing time and costs.

It is a further object of the invention to provide an alternating current electromagnet which reduces noise and vibration in the system.

It is a further object of the invention to provide an alternating current electromagnet with a shading coil which is retained and maintained in a pole face by a sideplate, and which position is assumed in the assembling of the electromagnet.

A further object of the invention is to provide a unique design for a sideplate for securing a shading coiling to a magnetic core.

A further object of the invention is to provide a sideplate for accomplishing the preceding object, whereby attachment of the sideplate to the core automatically holds the shading coil in the pole face.

A further object of the invention is to provide an alternating current electromagnet with opposed sideplates which interconnect two spaced-apart L-shape core sections.

These and other objects of the invention will be more fully understood from the following description of the invention, on reference to the illustrations appended hereto.

BRIEF DESCRIPTION OF THE DRAWINGS

FIG. 2 is an elevational view illustrating a magnetic assembly of FIG. 1, which assembly particularly illustrates the invention;

FIG. 3 is an enlarged, exploded view of a portion of FIG. 2; and

FIG. 4 is a side view.

DESCRIPTION OF THE PREFERRED EMBODIMENT

Figure 1:
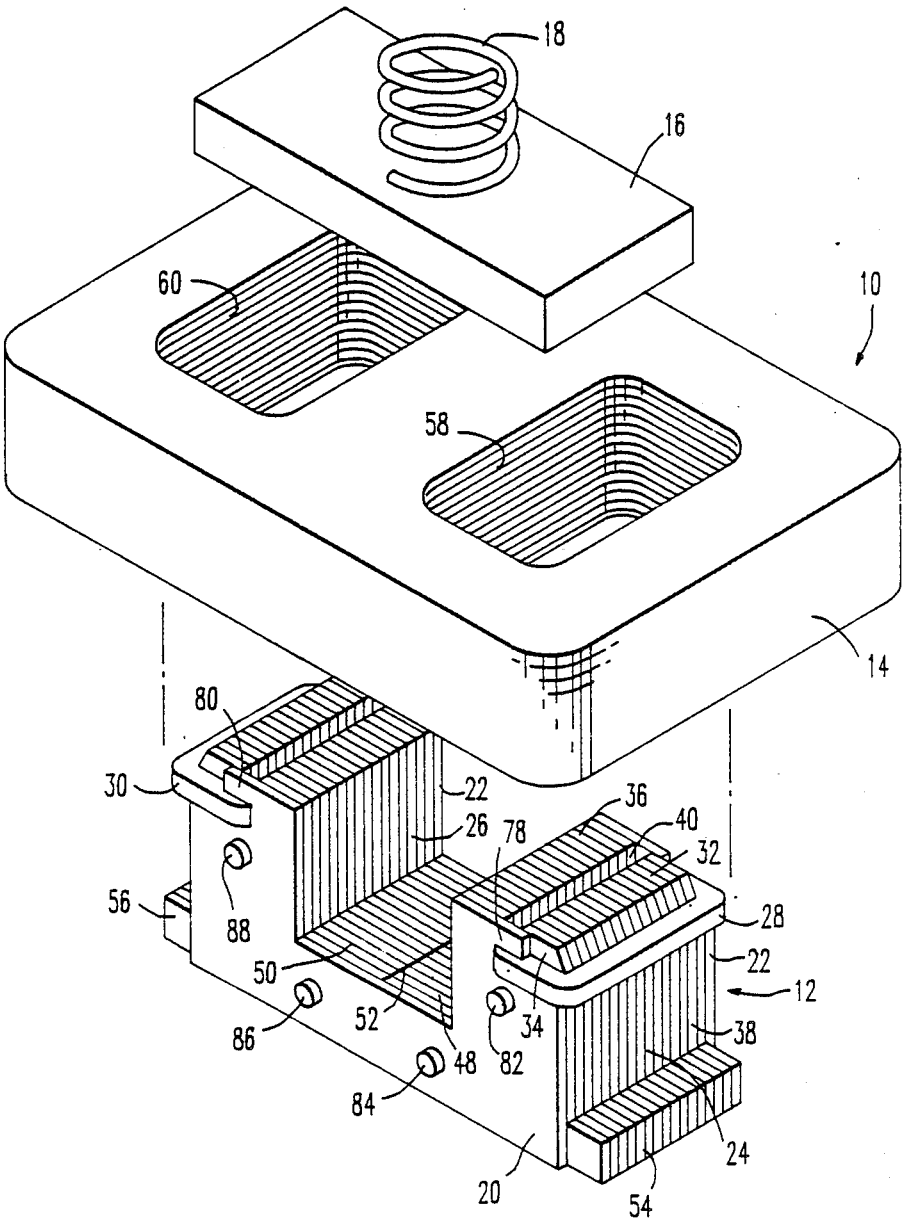
FIG. 1 is an exploded perspective view illustrating an assemblage of the components of an alternating current electromagnet wherein a preferred embodiment of the invention is employed.

FIG. 1 illustrates in an exploded view the main components of an alternating current electromagnet 10, in which the present invention has particular application.

Device 10 comprises a magnetic core assembly 12 (more about which will be discussed hereinafter), and a primary winding assembly 14. The top of FIG. 1 shows an armature 16 and a spring 18 of an electrical contactor (not shown). Magnetic core assembly 12 is comprised of sideplates 20 and 22, magnetic cores 24 and 26, and shading coils 28 and 30, in cores 24 and 26, respectively.

In further describing the invention reference will be made to FIGS. 1, 2, 3, and 4. Magnetic cores 24 and 26 are similar, but for purposes of discussion reference will be made to magnetic core 24. Magnetic core 24 has opposing longitudinal sides 32 and 34, and a top pole face 36 (FIG. 1), extending between sides 32 and 34. Extending perpendicularly to sides 32 and 34 of core 24 are two opposed longitudinal sides, where one such side is indicated at number 38 in FIG. 1.

Referring to FIGS. 1 and 3, an open channel 40 is formed in pole face 36 of core 24 and extends between sides 32 and 34 of core 24. FIG. 3 best illustrates open channel 40. Channel 40 is rectangular in cross section with two parallel side walls 42 and 44 and a floor 46 running perpendicularly relative to sidewalls 42 and 44.

Shading coil 28 is a single, winding coil formed in a circuitous, closed configuration. Shading coil 28 is placed into channel 40 with its surfaces being adjacent to sidewalls 42, 44 and floor 46 of channel 38 as particularly shown in FIG. 3. Shading coil 28 neatly fits into channel 40 with its bottom surface resting on floor 46 to assume its placement in channel 40 particularly illustrated in FIGS. 1 and 2.

Shading coils 28 and 30 typically are made of a non-magnetic, electrically conductive material such as a copper alloy or aluminum.

As is typical in the art, cores 24 and 26 are comprised of several punchings which form a stacking. These punchings are laminations typically punched from thin sheets of a magnetic material, such as silicon steel, and coated with an insulating varnish. These laminations reduce magnetic losses in magnetic cores 24 and 26 caused by eddy currents.

Magnetic cores 24 and 26, and shading coils 28 and 30 are well-known in the industry, and are easily available in the market.

As particularly illustrated in FIG. 1, cores 24 and 26 are formed in an L-shape configuration with the lower leg 48, 50 of each core 24, 26, respectively facing toward but not abutting each other to form a C-configuration for magnetic core assembly 12. The confronting surfaces (not shown) of these lower legs 48, 50 form a gap indicated at 52 which is approximately 0.004 inches wide. This gap 52 is filled with a non-magnetic material, such as mylar, in order to control the inductance of cores 24, 26.

Opposite to lower leg 48, 50 of core 24, 26 respectively is a foot indicated at 54 and 56 in FIGS. 1 and 2. Each foot 54, 56 is formed by an extension of the several punchings forming cores 24, 26 respectively, and are used to position magnet assembly 12 in a housing (not shown) of the contactor or other system in which the alternating current electromagnet is used.

Referring again to FIG. 1, primary winding assembly 14 is an integral member comprising series connected primary coils 58 and 60 encapsulated in a resin. This assembly 14 is placed onto magnetic assembly 12 such that primary coils 58 and 60 encircle cores 24, 26 respectively. Primary winding assembly 14 is well-known in present alternating current electromagnets.

The preceding components are typical components for a typical alternating current electromagnet. The invention particularly resides in a unique construction for sideplates 20 and 22 of magnetic assembly 12.

Further discussion will be made to sideplate 20 with reference to the figures. However, it is to be understood that sideplate 22 is similar to sideplate 20.

Sideplate 20 is in a C-shape with members 62, 64, and 66 (FIG. 2). At the top of each member 62, 66 of a sideplate 20, is a slot 68, 70 respectively (FIG. 3) with a lateral opening. As best shown in FIG. 3, each slot 68, 72 is formed by walls 72, 74, and 76. Directly above slot 68, 70 is a portion of sideplate indicated at 78, 80 in FIG. 3.

In assembling of sideplate 20 against cores 24, 26, the lateral opening of slot 68, 70 in members 62, 66 respectively, receives and encircles shading coil 28, 30 in a fashion particularly illustrated in FIG. 1. With particular reference to core 24 and member 62 of sideplate 20, portion 78 (FIGS. 2 and 3) abuts longitudinal side 32 of core 24 and extends across channel 40 of pole face 36 and adjacent to shading coil 28 to retain shading coil in pole face 36 along this side of core 24. In doing this, walls 72 and 76 of slot 68 align with floor 46 and sidewall 44 of channel 40.

This also applies to member 66 of sideplate 20 with respect to core 26. That is, portion 80 (FIGS. 1 and 2) of member 66 abuts a longitudinal side of core 26 and extends across the channel in the pole face of core 26 adjacent to shading coil 30 to retain shading coil in the pole face of core along this longitudinal side of core 26. This is particularly shown in FIGS. 1 and 2.

As discussed hereinbefore, sideplate 20 holds shading coils 28 and 30 in place on the one side of magnetic assembly 12. These coils 28 and 30 are held in place on the opposed parallel side of magnetic assembly 12 by sideplate 22, which is constructed similar to sideplate 20.

Sideplates 20 and 22 are made of a non-magnetic material, such as aluminum or stainless steel. As is well-known in the industry, sideplates 20 and 22 are attached to cores 24 and 26 through fastening means, such as a rivet. Such fastening means are indicated at 82, 84, 86, and 88 in FIGS. 1 and 2. These fastening means are made of a material such as medium carbon steel and extend from sideplate 20 through core 24 or 26, and through sideplate 22.

In assembling magnetic assembly 12, cores 24 and 26 are aligned relative to each other to form the C-shape shown in FIGS. 1 and 2. Shading coils 28, 30 are placed into the respective open channel in the pole face of cores 24 and 26. Both sideplates 20 and 22 are positioned so that their slots receive shading coils 28 and 30, and the sideplates 20 and 22 are fastened to cores 24 and 26. Shading coils 28 and 30 can only be removed when sideplates 20 and 22 are removed from magnetic assembly 12.

The attachment of sideplates 20 and 22 to cores 24 and 26 interconnect these cores 24 and 26 in such a manner that gap 52 is created and maintained between the confronting surfaces of legs 48 and 50 of cores 24 and 26, respectively.

Whereas a particular embodiment of the invention has been described above for purposes of illustration, it will be evident to those skilled in the art that numerous variations of the details may be made without departing from the invention as defined in the appended claims.

What is claimed is:

1. An alternating current electromagnet with a magnetic assembly, said magnetic assembly comprising:

a circuitous shading coil having a first portion, second and third portions each adjacent to said first portion, and a fourth portion adjacent to said second and third portions, magnetic core means having a pole face and two generally opposed parallel sides with an open channel formed in said pole face and extending from one said parallel side to the other said parallel side for receiving said first portion of said shading coil with said adjacent second portion extending along said one parallel side of said magnetic core means in a lateral direction and said third portion extending along said other parallel side of said magnetic core means in a lateral direction, sideplate means arranged along each of said two opposed parallel sides of said magnetic core means and attached to said core means, said each sideplate means having slot means with a lateral opening for receiving a different one of said second and third portions of said shading coil, and extension means located adjacent to said slot means and extending across said open channel along said opposed parallel sides of said magnetic core means in a manner to retain said shading coil in said open channel of said magnetic core means.

2. An electromagnet of claim 1, further including said magnetic core means being comprised of a plurality of magnetically permeable punchings aligned to form a stacking, fastening means for attaching said sideplate means on said each parallel opposed sides of said core means to said core means and extending through said core means to hold said punchings together.

3. An electromagnet of claim 1, wherein said open channel of said pole face has a floor which supports said shading coil in said channel and said slot means of said each sideplate is formed by three surfaces, one of which is lowermost relative to said sideplate, and further including means for aligning said floor with said lowermost surface of said slot means in said receiving of said second and third portions of said shading coil by said each sideplate.

4. An electromagnet of claim 1, further including said each sideplate being made of a nonmagnetically permeable material.

5. An electromagnet of claim 1, further including said non-magnetically permeable material of said each sideplate being aluminum.

6. An electromagnet of claim 1, further including said non-magnetically permeable material of said each sideplate being stainless steel.

7. An electromagnet of claim 1, further including:

said magnetic core means including a plurality of spaced apart interconnected cores, each said core having a said pole face with a said open channel in said pole face, a said shading coil in said each open channel of said each core, and including said sideplate means having a plurality of spaced apart interconnected sideplate portions cooperating with and equal in number to said plurality of said cores, such that said each sideplate portion is arranged on said two opposed sides of said each core and said each sideplate portion has slot means with a lateral opening for receiving a different one of said second and third portions of said respective shading coil, and extension means located adjacent to said slot means and extending across said open channel along said opposed parallel sides of said each core in a manner to retain said respective shading coil in said open channel of said core.

8. An electromagnet of claim 7, further including said plurality of cores and spaced apart members of said each sideplate being such as to form a C-configuration.

9. An electromagnet of claim 8, further including said magnetic core means consisting of two L-shape cores for said forming of said C-configuration, each said L-shape core having a lower leg with a confronting surface whereby the confronting surface of said each lower leg forms a gap with nonmagnetically permeable material in said gap, and said each sideplate means being a one-piece construction whereby said attachment of said each sideplate means to said magnetic core means interconnects said two L-shape cores of said magnetic core means.

10. An alternating current electromagnet with a magnetic assembly, said magnetic assembly comprising:

a circuitous shading coil having a first portion and adjacent second and third portions, magnetic core means having a pole face and two generally opposed sides with an open channel formed in said pole face, and extending between said opposed sides for receiving said first portion of said shading coil with said each adjacent second and third portions extending along a different one of said sides of said magnetic core means in a lateral direction, and sideplate means arranged along each of said two opposed sides of said magnetic core means and attached to said core means, said sideplate means along at least one of said two opposed sides of said magnetic core means having slot means with a lateral opening for receiving said second portion of said shading coil, and extension means located adjacent to said slot means and extending adjacent to said second portion across said open channel in said lateral direction in a manner to retain said shading coil in said open channel of said magnetic core means.

11. An alternating current electromagnet with a magnetic assembly, comprising:

magnetic core means having two L-shaped, spaced-apart members arranged to form a C-configuration, each said core member having a pole face and two opposed sides with an open channel formed in said pole face and extending between said opposed sides, a circuitous shading coil for each said core member and having a first portion and adjacent second and third portions with said first portion being located in said channel and said second and third portions extending in a lateral direction along a different side of said opposed sides of said core member, a first sideplate having two spaced apart interconnected members forming a C-configuration and attached to one of said opposed sides of said each core member to connect said core members together, each said spaced-apart members of said first sideplate being associated with a different core member of said spaced apart core members and its respective shading coil, said each spaced apart members of said first sideplate having slot means with a lateral opening for receiving said second portion of its said respective shading coil, and extension means located adjacent to said slot means and extending across said open channel in its said associated core member along said one of said opposed sides of its associated core member in a manner to retain said respective shading coil in said spaced apart core members on said one opposed side of said each core member, and a second sideplate having two spaced apart interconnected members forming a C-configuration and attached to the other of said opposed sides of said each core member to connect said core members together, each said spaced apart members of said second sideplate being associated with a different core member of said spaced-apart core members and its respective shading coil, said each spaced apart members of said second sideplate having slot means with a lateral opening for receiving said third portion of its respective shading coil, and extension means located adjacent to said slot means and extending across said open channel in its said associated core member along said other opposed side of its associated core member in a manner to retain said respective shading coil in said spaced apart core members on said other opposed side of said each core member of said magnetic core means, and means for fastening said magnetic core means, said first sideplate, and said second sideplate together as a unit.

* * * * *